United States Patent [19]

Dobbie

[11] 4,271,746

[45] Jun. 9, 1981

[54] AUTOMATIC MUSICAL TUNING DEVICE

[76] Inventor: John G. Dobbie, 15 Pleasant Ave., East Lindfield, New South Wales 2070, Australia

[21] Appl. No.: 117,602

[22] Filed: Feb. 1, 1980

Related U.S. Application Data

[63] Continuation of Ser. No. 923,869, Jul. 12, 1978, abandoned.

[30] Foreign Application Priority Data

Jul. 12, 1977 [AU] Australia ..... PD0804
Apr. 12, 1978 [AU] Australia ..... PD3987

[51] Int. Cl.[3] ..... G10G 7/02
[52] U.S. Cl. ..... 84/454; 84/DIG. 18; 324/78 D; 324/78 Z; 324/8 L

[58] Field of Search ..... 84/454, 455, 456, DIG. 18; 324/78 F, 81, 82, 78 D, 78 R, 78 Z, 83 FE; 307/220 R, 225 R, 232; 330/302, 303; 333/117; 323/119, 123; 328/138

[56] References Cited

U.S. PATENT DOCUMENTS

| | | | |
|---|---|---|---|
| 3,564,441 | 2/1971 | Eide | 330/302 |
| 4,120,229 | 10/1978 | Ota | 84/454 |
| 4,122,751 | 10/1978 | Caluin | 84/454 |
| 4,207,791 | 6/1980 | Murakami | 84/454 |

*Primary Examiner*—L. T. Hix
*Assistant Examiner*—Stafford D. Schreyer
*Attorney, Agent, or Firm*—Ladas & Parry

[57] ABSTRACT

An electronic automatic musical tuning device whereby an incoming tone from a musical instrument is picked up by a microphone, amplified and transformed to a square wave signal and compared in a phase locked loop with a progressive series of standard frequencies until matching occurs and the loop is locked to enable a display of the tone in a convenient output such as a row of lights.

6 Claims, 7 Drawing Figures

AUTOMATIC MUSICAL TUNING DEVICE

This is a continuation of application Ser. No. 923,869, filed July 12, 1978, abandoned.

This invention relates to an automatic musical tuning device.

In the past electronic musical tuning devices have been provided for the tuning of instruments whereby the desired tone is set manually on the device and the input to the device compared with the set tone. This apparatus has the disadvantage that each note must be individually set which is of course tedious and time consuming.

It is therefore an object of the present invention to provide an automatic musical tuning device which will obviate or minimise the foregoing disadvantage in a simple yet effective manner or which will at least provide the public with a useful choice.

Accordingly the invention consists in an automatic musical tuning device comprising an input microphone, conversion circuitry capable of amplifying and processing the input from the microphone to form a discrete waveform of frequency having a known relationship to the incoming tone, a phase locked loop having two comparator inputs, one said input being connected to the output from said conversion circuitry and the other said input being derived from an oscillator through frequency dividers, logic circuitry arranged to switch successive division ratios from said oscillator into said phase locked loop until said phase locked loop locks onto the input tone from said conversion circuitry, an output display comprising a visual representation of the tone locked into said phase locked loop, and output circuitry adapted to enable said output display when triggered by said phase locked loop.

Notwithstanding any other forms which may fall within its scope the invention will hereinafter be described in one preferred form by way of example only with reference to the accompanying drawings in which.

The device responds to a musical tone, giving a readout of relative sharpness or flatness with respect to the nearest note on a musical scale defined within the device, normally an equal tempered scale. The device may also indicate which note is the nearest note to the incoming tone.

The response is automatic in so far as individual notes do not have to be selected by switches. The readout is linear in cents (100 cents = one semitone) and direct, not relying upon stroboscopic effects.

Figure 1:
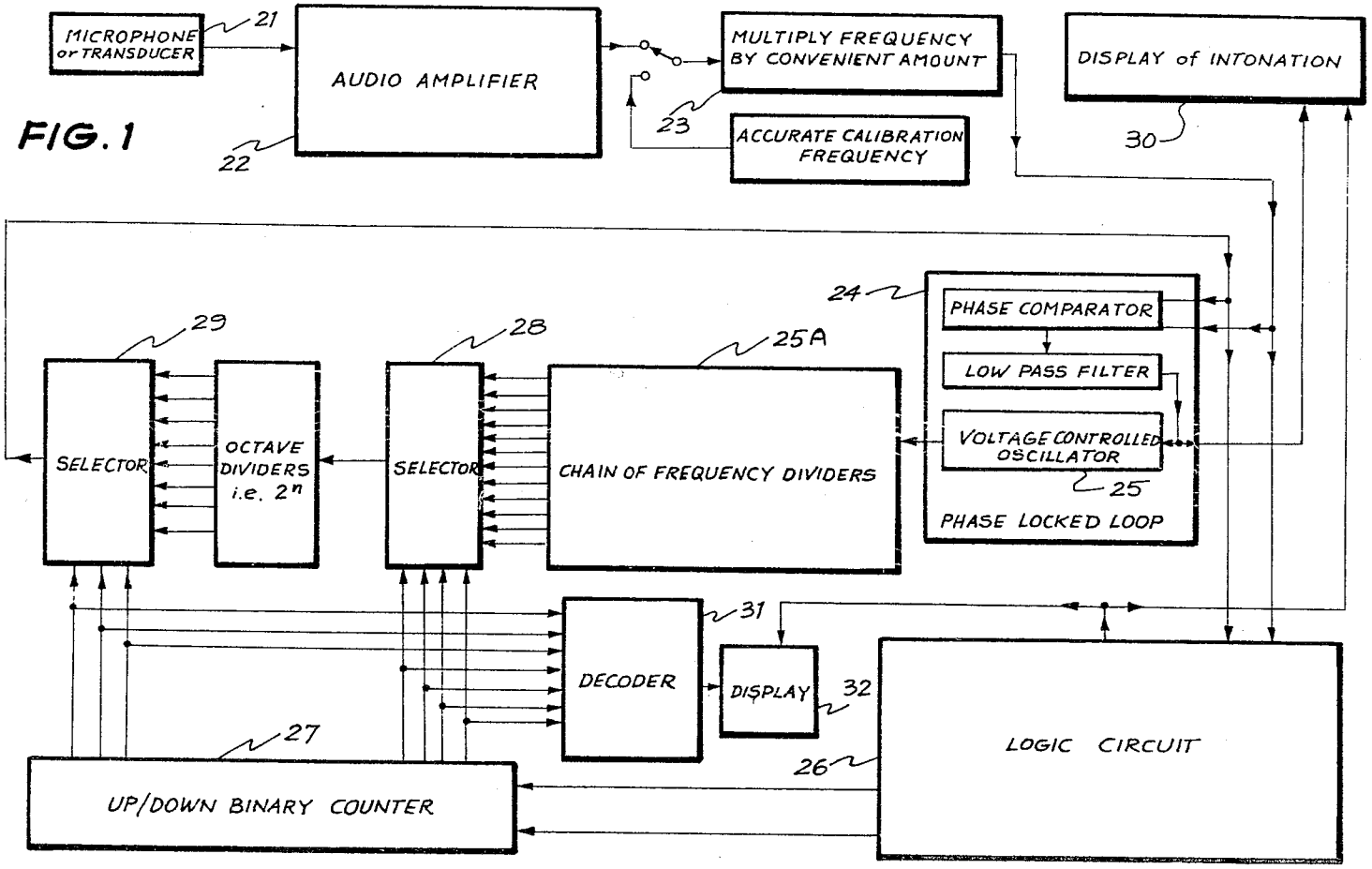
FIG. 1 is a block circuit diagram of an automatic musical tuner according to the invention.

The method of determining which note is the nearest to the tone being tested is as follows with general reference to the circuit blocks shown in FIG. 1. The tone is picked up by a microphone 21, amplified and processed by circuit 22 in such a way that a rectangular waveform of frequency which has a known relationship to the incoming tone is formed. This frequency is multiplied by a convenient number by circuit 23 forming a square wave of equal mark/space ratio, as will be described later. The signal is then applied to one of the two comparator inputs of a main phase locked loop (PLL) 24.

The other comparator input is derived from the PLL voltage controlled oscillator 25 (VCO) through frequency dividers 25A, there being a specific division ratio for each and every note within the range of the testing instrument. Thus if the instrument has a range of seven octaves, each with twelve different notes, there would be 84 different division ratios.

The PLL is adjusted to have a capture range just less than half a semitone on either side of any particular note in the scale, so that only one of the available division ratios will allow the PLL to come into the locked condition.

Logic circuitry 26 is provided which responds if the PLL is not locked or if the two signals at the comparator input are not of the same frequency. This response causes various division ratios to be switched successively into the PLL until the one is found which enables the PLL to lock on to the tone being tested. Each division ratio is allocated a binary number, and may be selected by the output of a counter 27 through selectors 28 and 29. The logic circuitry can determine whether to count up or down so as to reach the correct division ratio in the shortest time. When the correct division ratio and phase relationship is achieved, the PLL locks and the binary count remains stable.

Sometimes the correct division ratio is achieved but the phase is incorrect. In this instance, the counting will continue, but will be reversed in direction at the next count. Thus the correct division ratio will again be tried. This may continue until the correct phase relationship is achieved and lock results.

Shortly after lock is achieved, a display of intonation 30 in the form of a row of lights is enabled. This may be of light emitting diodes arranged in a straight line. The display is not enabled until a short time after lock is achieved to avoid invalid display. The circuit may also include a decoder 31 arranged to determine the actual note locked in the phase locked loop and display the note e.g. as "C", "Bb" etc. through a display 32.

When lock is achieved the control voltage of the PLL VCO becomes stable. This voltage is used to determine which light or lights in the display turn on. If the incoming tone being tested is near the high end of the PLL lock range then lights near the top or one end of the display will turn on. If the incoming tone starts lowering in pitch, then the lights appear to travel down or along the display towards the other end, and vice versa.

The instrument is calibrated by using a crystal oscillator and frequency dividers to give a desired fixed reference frequency. The PLL and display are adjusted so that the display shows lights in a reference position for the reference frequency. This would normally be in the centre, using a green coloured light for example. Lights on either side of the reference are yellow, and further away, red, so that error may be easily read.

Figure 2:
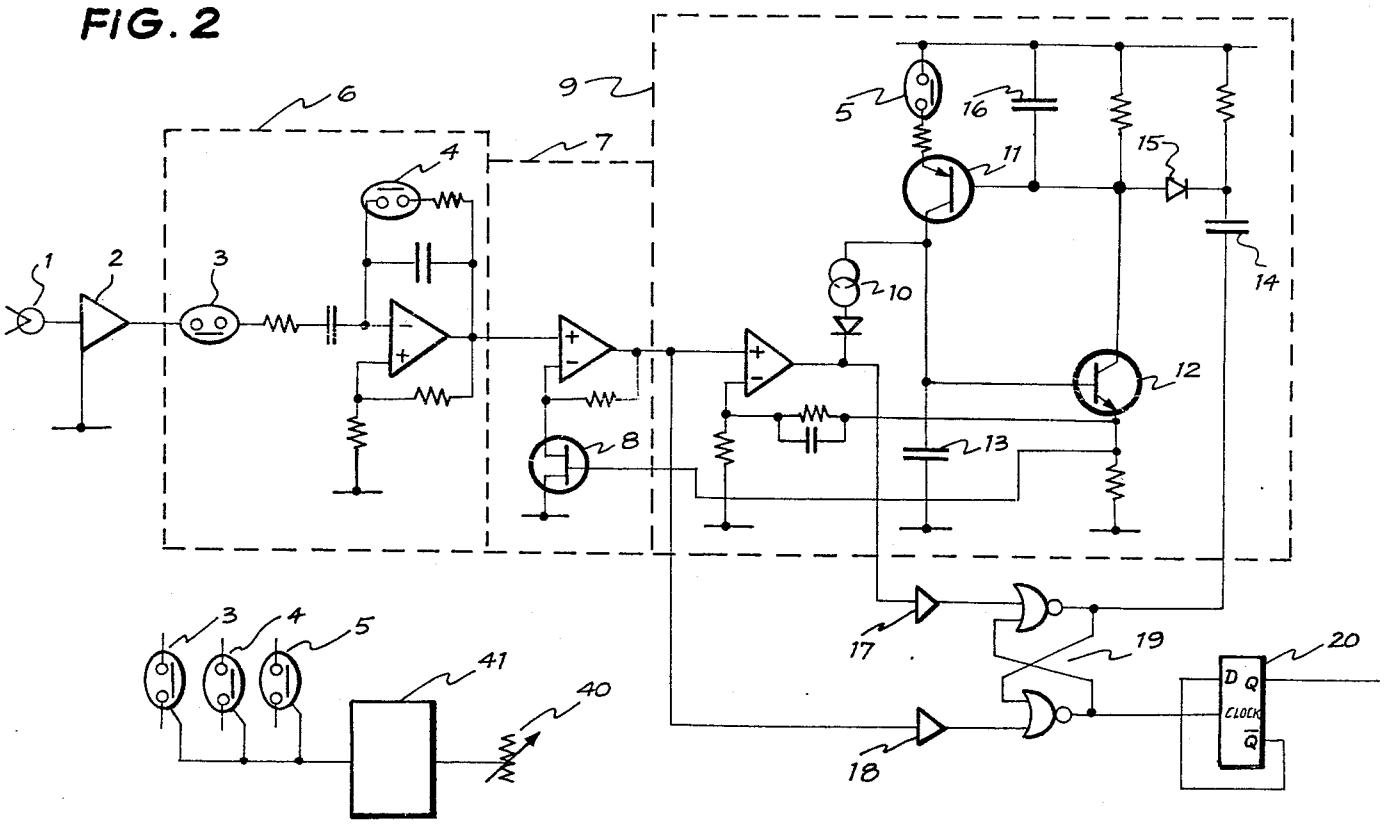
FIG. 2 is a circuit diagram of the conversion circuitry shown in FIG. 1.

The problems and method of converting the complex and varying waveforms of musical tones into rectangular waves or discrete pulses of the same frequency will now be generally described followed by a specific description of one form of conversion circuitry as shown in FIG. 2.

The main problems to be overcome in processing the incoming audio signal are as follows:

1. The waveform sometimes has many zero crossings per cycle.

2. The waveform sometimes has several peaks of similar amplitude per cycle.

3. The waveform sometimes has very little fundamental frequency present.

Figure 5:
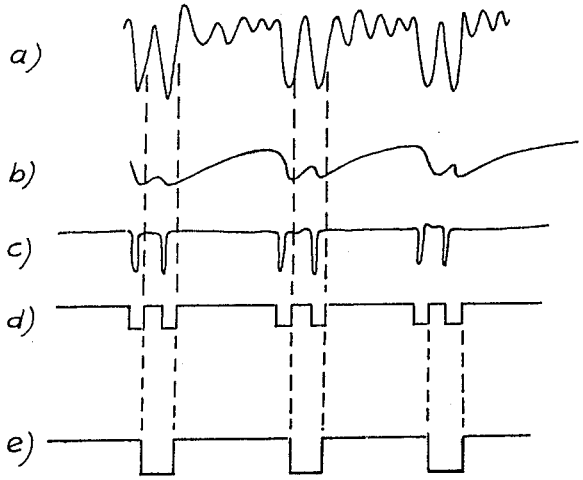
FIG. 5 is a series of waveforms showing the conversion from the audio input waveform to a desired square waveform.

These features may be seen in the uppermost waveform of FIG. 5.

Schmidt trigger circuits may be considered for this application but they do not give an output suitable for the main phase locked loop to act upon from such waveforms.

The audio signal from a transducer such as a microphone is amplified and filtered so as to reduce but not eliminate the harmonic content, and to reduce noise below the frequencies of interest. A band pass filter is used as the shape of the frequency response curve can be easily adjusted. The frequency of maximum pass is made controllable from the front panel of the device. This control also adjusts a parameter in the peak detector to be described later.

The filtered audio signal is then applied to a combined automatic gain control and peak detecting circuit. This circuit attempts to respond only to the highest one or two peaks per cycle, although this could be extended to more peaks per cycle. When a peak is detected, a pulse is generated which sets a bistable circuit. As the audio signal returns from the peak it will eventually cross the threshold of a level detector which resets the bistable circuit.

The output of this bistable circuit is a rectangular wave suitable as input to available logic families. This output is applied to a divide by two circuit so as to produce a rectangular wave with only one transition in each direction per cycle. Further divide by two circuits may be used as required. The resulting waveform may be $\frac{1}{2}^n$ of the frequency of the audio input (n an integer), however this only has the effect of internally changing octaves, which does not affect the use of the tuner.

A further requirement of the circuit is that it should respond to as wide a range of input frequencies as possible for a given setting of the front panel control mentioned earlier.

Parameters in the peak detecting circuit which ensure good results for low frequency audio signals work against good results for higher frequency signals.

One of the parameters in the peak detecting circuit is arranged so that it is dependent on the audio signal frequency. Thus for a higher frequency input, the peak detector circuit self adjusts so as to improve its response. This occurs at the expense of discrimination against harmonics, however the higher frequency audio signals from a given musical instrument nearly always have lower harmonic content.

The output of the divide by two circuit(s) is applied to the phase locked loop.

The parameter in the peak detector circuit which is frequency dependent and self adjusting, is the capacitor discharge rate which is also under the control of the front panel control.

The conversion circuit generally described above which converts audio input signal into rectangular wave of related frequency suitable for application to the phase locked loop will now be specifically described with reference to FIG. 2, in which the output from a microphone is connected to a low noise amplifier 2 the output from which is fed to a band pass filter shown in block 6.

3, 4 and 5 are semiconductor bilateral switches (e.g. CMOS type 4016) all driven so as to have an open to closed ratio controllable from a front panel control 40. When this control is set correctly for the desired range of musical tones, the switching frequency or rate is sufficiently higher than the audio frequencies being processed so that interference does not occur. The switches have the effect of multiplying the effective resistance of the resistors in series with them by the off to on ratio of the switches. The current pulses in the circuit are averaged by the associated circuit capacitances. The switches are all driven from the same source i.e. pulse generator 41 so as to avoid mutual interference.

The block 6 is a band pass filter whose centre frequency of maximum pass is controllable via switches 3 and 4 from the front panel control 40.

The block 7 is an amplifier whose gain is controllable with the voltage applied to the gate of field effect transistor 8. The output of this block is substantially constant in amplitude for widely varying input amplitudes. The control voltage for this block is derived from capacitor 13 via transistor 12.

Figure 6:
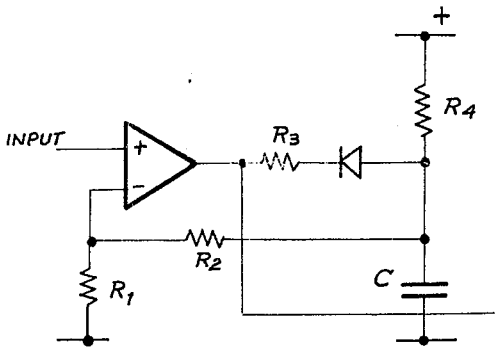
FIG. 6 is a simplified form of conversion circuitry shown for the purposes of explanation.

The block 9 is a peak detector circuit, which can best be explained by reference too FIG. 6 which is a simplified form of this circuit.

$R_1$ and $R_2$ allow the circuit to have gain. However the circuit would still work if $R_1=\infty$ and $R_2=0$ but the input excursion would have to equal the negative excursion of the voltage on the capacitor.

$$R_3 << R_4$$

The current flowing through $R_4$ controls the rate of rise of the voltage on the capacitor between detected peaks.

Figure 7:
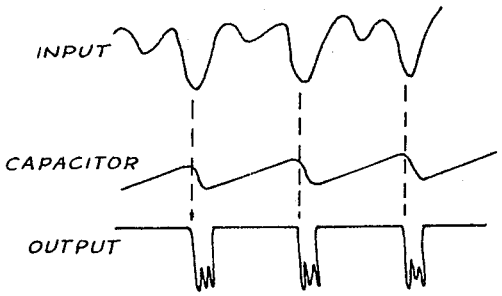
FIG. 7 is a waveform diagram in conjunction with FIG. 6.

The presence of $R_3$ allows the output to give negative pulses of sufficient amplitude to drive other circuitry. FIG. 7 shows the waveforms at input, at the capacitor C, and at the output from the peak detector circuit.

The actual peak detecting circuit shown at 9 in FIG. 2 is similar to this except as follows:

$R_3$ is replaced by a constant current circuit 10, so only a certain value of current will flow when the diode is forward biased. This allows the circuit to behave more uniformly.

$R_4$ is replaced by a current generator whose current is controlled from three different sources:

1. The emitter circuit of transistor 11 contains switch 5, previously described, whose off to on ratio is controlled from the front panel control 40. This controls the capacitor discharge rate.

2. The base voltage of 11 is controlled by the current flowing through transistor 12. This current is controlled by the voltage of its own base, which is inversely proportional to the audio signal amplitude. This has the effect of steepening the discharge curve of the capacitor 13 for low amplitude audio input signals. This helps to counteract the effect of noise but is offset by loss of discrimination against harmonics i.e. against smaller peaks within each cycle of audio signal.

3. The base voltage of transistor 11 is further modified by current pulses coming through capacitor 14 and being rectified by diode 15. For lower frequencies the average voltage shift on the base of transistor 11 is not very great, but as the audio frequency rises the average voltage at this transistor base falls thus increasing the discharge current of capacitor 13 and thus allowing the circuit to function with the higher frequency audio signal.

This part of the circuit also has an effect on the shape of the voltage discharge curve of capacitor 13.

Figure 4:
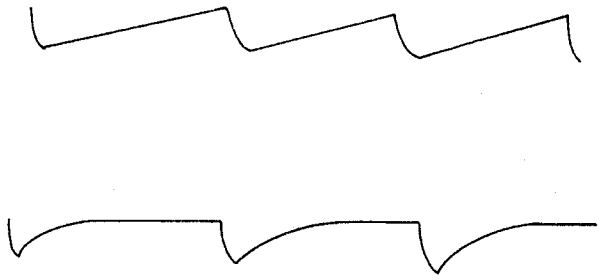
FIG. 4 is a comparison of the peak detector waveform as used in apparatus according to the invention with conventional peak detector waveform.

In the case of the simple peak detector the waveform is as shown in the upper portion of FIG. 4 where the increase slope is substantially linear. In the actual circuit shown in FIG. 2 the increase slope is substantially exponential as shown in the lower part of FIG. 4.

It can be seen that the slope just after each peak is detected is greater than at subsequent times. This has the effect of allowing the circuit to detect the faster recurring peaks of a higher frequency audio signal, thus increasing substantially the range of notes the circuit will respond to for a given setting of the front panel control. The flattening off of the curve provides the required discrimination against smaller peaks within the cycle of a low frequency wave, i.e. the discrimination against harmonics.

Capacitor 16 integrates the pulses coming through capacitor 14 and diode 15, and supplies pulses of base current if transistor 11 caused by the switching of 5.

17 and 18 are level detectors and amplifiers which provide signals compatible with the logic gates which follow.

19 is a bistable circuit which is set by "peak" pulses and reset by a level being crossed as the waveform returns from its peak excursion.

20 is a divide by two circuit implemented with a D type flip flop logic element.

The purpose of this is as follows:

At low frequencies the peak detector may detect two peaks per cycle as shown at (a) in FIG. 5. This causes the waveform at the capacitor 13 to take the configuration shown at (b) giving two peaks per cycle as at (c). The resulting bistable output shown at (d) is unsuitable to be fed to the phase locked loop and so must be processed by the divide by two circuit 20 to give the required waveform output signal shown at (e) having only one transition in either direction per cycle.

This output signal is then applied to a phase locked loop (other than the main one previously described), with wide capture range and incorporating a suitable frequency divider so that an exact multiple of the input frequency is generated. This has equal mark/space ratio, i.e. is a square wave. The purpose of this multiplier is to speed up the response of the whole system which can otherwise be rather slow for input tones of low frequency.

Figure 3:
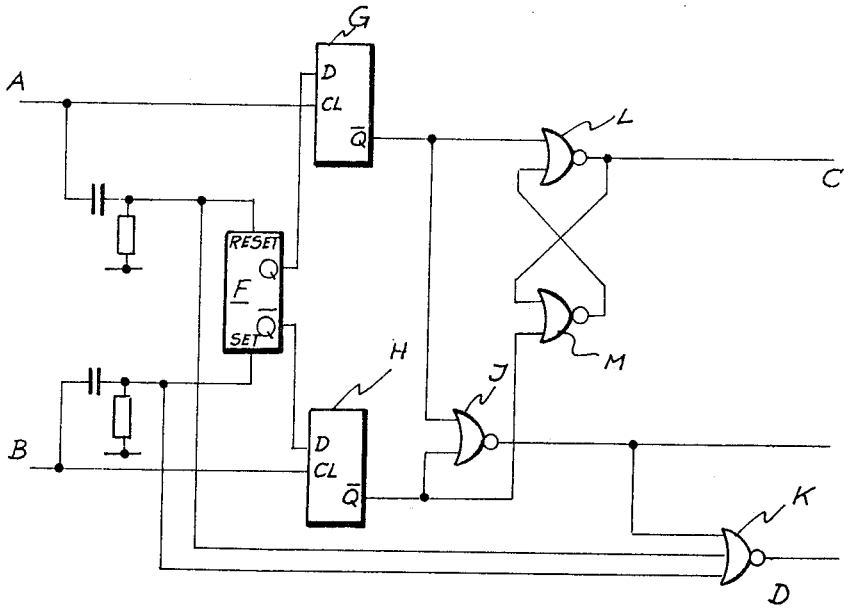
FIG. 3 is a circuit diagram of a portion of the output circuitry of the musical tuning device.

The logic circuitry 26 which allows the correct division ratio for a given input to be found is now described with reference to FIG. 3. This circuitry gives no response when the main PLL 24 is in the locked state. When the PLL is not locked, the circuit issues clock signals and count direction signals to the counter.

When the PLL is locked, for each transition between 0 and 1, or 1 and 0 of one of the two comparator inputs, there is a corresponding transition of the other input. When the PLL is not locked there may be more than one transition on one input for each one on the other input. Depending on which input has excess transitions, a signal is issued to the counter 27 to count in the direction which selects division ratios which minimizes the discrepancy. When excess transitions occur in either input, clock signals are issued which advance the counter in the direction chosen. FIG. 3 shows a circuit which responds as described above. A and B are connected to the two comparator inputs of the main PLL. The signal at C controls whether the counter counts up or down. The signal at the output of D clocks the counter causing it to advance one count in the direction specified by C. G and H are data flip flops: The outputs are updated on receipt of a transition at the corresponding clock inputs. F is a set/reset flip flop. The circuit relies on a small delay in the response of this flip flop.

The other circuit elements J, K, L and M are NOR gates.

The output of nor gate J is logical high when the main PLL is locked, and low when the main PLL is not locked, allowing signals to pass to the output of D which clock the counter.

The signal at the output of J is fed to a circuit incorporating a short delay which blanks the display when the main PLL is not locked.

Although this description shows one way of performing this function it will be appreciated that other types of logic elements could be used in an appropriate circuit to achieve the same result.

What I claim is:

1. An automatic musical tuning device adapted to display a representation of an individual note from an incoming tone, said device comprising an input microphone, conversion circuitry connected to said microphone for amplifying and processing the input from the microphone to form a discrete waveform of frequency having a known relationship to the incoming tone, a phase locked loop having two comparator inputs, one said input being connected to the output from said conversion circuitry and the other said input being derived from an oscillator through frequency dividers controlled by logic circuitry arranged to automatically switch successive division ratios corresponding to individual notes from said oscillator and frequency dividers into said phase locked loop until said phase locked loop locks onto the input tone from said conversion circuitry, an output display comprising a visual representation of the tone locked into said phase locked loop, and output circuitry connected between said phase locked loop and said output display for enabling said output display when triggered by said phase locked loop.

2. An automatic musical tuning device as claimed in claim 1 wherein said conversion circuitry includes an amplifier connected to said microphone, a band pass filter connected to said amplifier arranged to reduce the harmonic content and noise of said incoming tone, a combined automatic gain control and peak detecting circuit connected to the output from said filter, and a pulse generator arranged to be triggered by the peaks detected by said peak detecting circuit.

3. An automatic musical tuning device as claimed in claim 2 wherein the output from said pulse generator is applied to set a bistable circuit the output from which is applied to one or more divide by two circuits to form a square wave of equal mark to space ratio.

4. An automatic musical tuning device as claimed in claim 1 wherein said logic circuitry includes a counter and components arranged to issue clock signals and count direction signals to said counter when said phase locked loop is not locked, the output from said counter being applied to selectors arranged to select said successive division ratios from said oscillator for switching into said phase locked loop.

5. An automatic musical tuning device as claimed in claim 1 wherein said output display comprises a row of lights arranged to indicate the tone of the note locked into the phase locked loop.

6. An automatic musical tuning device as claimed in claim 1 wherein said output display includes an indication of the note locked into said phase locked loop.

* * * * *